United States Patent [19]

Bohler et al.

[11] Patent Number: 4,688,438

[45] Date of Patent: Aug. 25, 1987

[54] SWITCH OR CONTROL CABLE ARRANGEMENT AND METHOD OF USING THE SAME

[75] Inventors: Erwin Bohler; Werner Bruderer, both of Zürich, Switzerland

[73] Assignee: Werkzeugmaschinenfabrik Oerlikon-Bührle AG, Zürich, Switzerland

[21] Appl. No.: 797,416

[22] Filed: Nov. 12, 1985

[30] Foreign Application Priority Data

Nov. 26, 1984 [CH] Switzerland ..... 05623/84

[51] Int. Cl.[4] ..... G05G 1/24

[52] U.S. Cl. ..... 74/2; 74/479; 89/12

[58] Field of Search ..... 74/2, 479; 89/12

[56] References Cited

U.S. PATENT DOCUMENTS 4,059,025 11/1977 Waack et al. ..... 74/482
4,351,198 9/1982 Hansen ..... 74/482
4,574,654 3/1986 Griffiths ..... 74/479

FOREIGN PATENT DOCUMENTS 0111240 6/1984 European Pat. Off. .

*Primary Examiner*—Stephen C. Bentley
*Attorney, Agent, or Firm*—Werner W. Kleeman

[57] ABSTRACT

Switch or control cables for switching-over or changing-over deflectors are known and have the disadvantage that they can only be operated from one predetermined location. In accordance with the invention, the switch or control cable is subdivided into two switch or control cable sections which are interconnected by a coupling. The switch or control cable which is tensioned by a spring can now be selectively released from a holding device for switching-over or changing-over the deflector and displaced by the spring or by disengaging the coupling, in which case only one of the two switch or control cable sections is displaced by the spring.

4 Claims, 7 Drawing Figures

SWITCH OR CONTROL CABLE ARRANGEMENT AND METHOD OF USING THE SAME

CROSS-REFERENCE TO RELATED APPLICATION

This application is related to our commonly assigned, copending U.S. patent application Ser. No. 06/797,213, filed Nov. 12, 1985, and entitled "Monitoring Apparatus for Monitoring Delayed Firing Cartridges in an Externally Powered Firing Weapon", the disclosure of which is incorporated herein by reference.

BACKGROUND OF THE INVENTION

The present invention broadly relates to a new and improved constrution of a switch or control cable arrangement. The present invention also relates to a new and improved method of using such switch or control cable arrangement.

In its more particular aspects, the present invention specifically relates to a new and improved construction of a switch or control cable arrangement containing a switch or control cable which is tensioned by means of a spring and which is released, for a switching and/or controlling operation, from a holding device and displaced under the action of the spring.

Furthermore, such a switch or control cable arrangement may serve, for example, for switching-over or changing-over a deflector or deflecting means in a firing weapon like a Gatling gun for interrupting continuous firing either in the case of delayed firing of a cartridge or for changing-over to a single-shot operation.

Such known switch or control cable has the disadvantage that it can be operated only from one predetermined location by releasing the holding device.

SUMMARY OF THE INVENTION

Therefore, with the foregoing in mind, it is a primary object of the present invention to provide a new and improved construction of a switch or control cable arrangement which does not exhibit the aforementioned drawbacks and limitations of the prior art constructions.

A further important object of the present invention is to provide a new and improved construction of a switch or control cable arrangement which can be operated from at least two locations, for instance, in order to switch-over or change-over a deflector or deflecting means.

Now in order to implement these and still further objects of the invention, which will become readily apparent as the description proceeds, the present development is manifested by the features that the switch or control cable comprises two switch or control cable sections which are interconnected by means of a coupling. Upon disengaging the coupling, only one of the two switch cable sections is displaced by means of the spring. When the coupling is engaged and the holding device is released, both switch or control cable sections are conjointly displaced under the action of the spring.

As already alluded to above, the present invention is not only concerned with the aforementioned cable arrangement but also relates to a new and improved method of using such switch or control cable arrangement for operating, for example, in a Gatling gun, interrupting means for interrupting a continuous firing operation of the Gatling gun in the presence of a delayed firing cartridge and in the case of a change-over to a single-shot operation of the Gatling gun.

More specifically, the inventive method of using the switch cable arrangement entails the steps of using a switch or control cable containing two switch or control cable sections, namely a first switch or control cable section and a second switch or control cable section. The switch or control cable is releasably held in a holding device and tensioned by means of a spring. The two switch or control cable sections are disengageably interconnected by a coupling. The first switch or control cable section is connected to the interrupting means. The holding device is operatively connected to a delayed firing cartridge such that said switch or control cable is released in its entirety from said holding device and is displaced conjointly with the first switch or control cable section, which is connected with the interrupting means, under the action of the spring in order to operate the interrupting means in the presence of a delayed firing cartridge. Conversely, the coupling is disengaged such that the first switch or control cable section, which is connected with the interrupting means, is displaced under the action of the spring in order to operate the interrupting means when changing over to the single-shot operation of the Gatling gun.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein:

FIG. 1 shows the starting position of the switch or control cable arrangement with the switch or control cable arrangement in the tensioned condition;

FIG. 2 shows the switch or control cable arrangement shown in FIG. 1 and with the switch or control cable in the untensioned condition when released from a holding device of the switch or control cable arrangement;

FIG. 3 shows the switch or control cable arrangement shown in FIG. 1 and with the switch or control cable in the tensioned condition and with a coupling of the switch or control cable arrangement in the disengaged state;

FIG. 4 shows the switch or control cable arrangement shown in FIG. 1 with the switch or control cable in the untensioned or released condition and with the coupling of the switch or control cable arrangement in the disengaged state;

FIG. 5 shows the switch or control cable arrangement shown in FIG. 1 during a first phase of an engaging operation of the coupling with the switch or control cable in the tensioned condition;

FIG. 6 shows the switch or control cable arrangement shown in FIG. 1 during a second phase of the engaging operation of the coupling with the switch or control cable in the tensioned condition; and FIG. 7 shows the switch or control cable shown in FIG. 1 during a third phase of the engaging operation of the coupling with the switch or control cable in the tensioned condition.

DETAILED DESCRIPTION OF THE PREFERRED EMBODIMENTS

Figure 1:
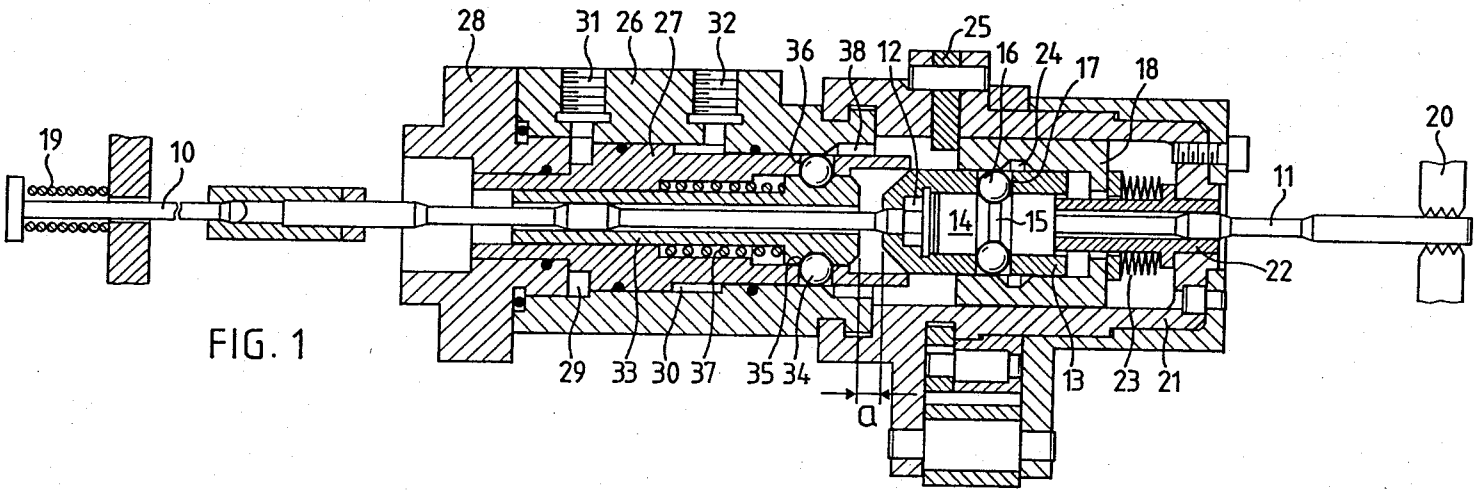
FIGS. 1 to 7 show longitudinal sections through an exemplary embodiment of the inventive switch or control cable arrangement in various operational phases, namely.

Describing now the drawings, it is to be understood that to simplify the showing thereof, only enough of the structure of the switch or control cable arrangement has been illustrated therein as is needed to enable one skilled in the art to readily understand the underlying principles and concepts of this invention. Turning now specifically to FIG. 1 of the drawings, the arrangement depicted by way of example and not limitation therein will be seen to comprise a switch or control cable 9 which contains a first switch or control cable section 10 and a second switch or control cable section 11 which are intended to be coupled or decoupled depending on the type of operation to be selected or controlled by means of the switch or control cable arrangement. Fixed to the right-hand end of the first switch or control cable section 10 is a first cable head 12 which is fixedly anchored in a bushing 13. At the left-hand end of the second switch or control cable section 11, there is fixed a second cable head 14 which, however, is displaceably guided in the bushing 13. This second cable head 14 possesses a groove 15 into which there project two spherical or ball-shaped locking bodies 16. Furthermore, these locking bodies 16 project into radial bores or holes 17 in the bushing 13, whereby there is prevented a displacement of the second cable head 14 in the bushing 13. The two switch or control cable sections 10 and 11 are thus rigidly interconnected by means of the bushing 13 and the two locking bodies 16.

Figure 2:
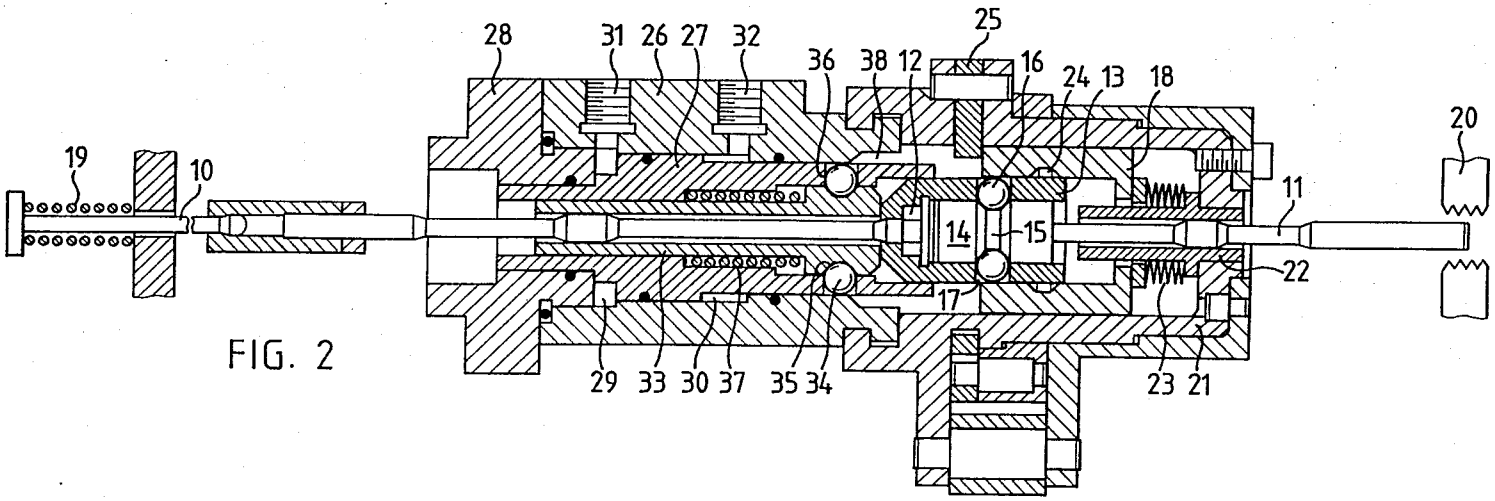

The bushing 13, in turn, is displaceably guided in a further bushing 18 and consequently, the two switch or control cable sections 10 and 11 can be displaced conjointly with the bushing 13 and the locking bodies 16. In FIG. 2, there is depicted the left end position of the switch or control cable 9 containing the two switch or control cable sections 10 and 11.

For the following, it will be assumed that a compression spring 19 connected with the first or left-hand switch or control cable section 10 has the tendency to displace the switch or control cable 9, i.e. at least the first or left-hand switch or control cable section 10 towards the left. It will be further assumed that a schematically illustrated clamping or holding device 20 is provided at the second or right-hand switch or control cable section 11 for clamping or holding or releasing at least the second or right-hand switch or control cable section 11. As can be seen from FIG. 2, when the clamping arrangement or holding device 20 is released or opened, the switch or control cable 9 including the two switch or control cable sections 10 and 11 is displaced in its entirety towards the left and the compression spring 19 can be released.

Figure 3:
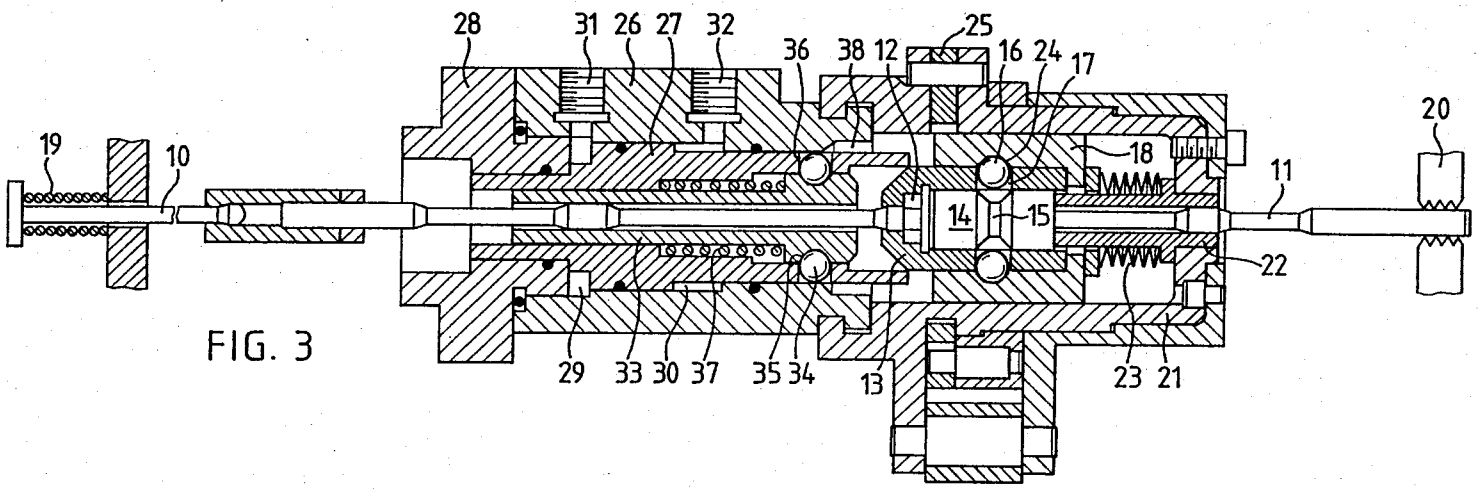

In accordance with FIG. 1, the further bushing 18 is mounted in a housing 21 and is displaceable therein under the force of a compression spring 23 from a blocking position shown in FIG. 1 to a releasing position shown in FIG. 3. A sleeve 22 is fastened to this housing 21 and the compression spring 23 is displaceably guided at the sleeve 22. This compression spring 23 is supported at a collar of the sleeve 22 and via a washer at the further bushing 18. The compression spring 23 has the tendency to displace the further bushing 18 in the housing 21 towards the left into the releasing position, as will be evident from FIG. 3.

Figure 4:
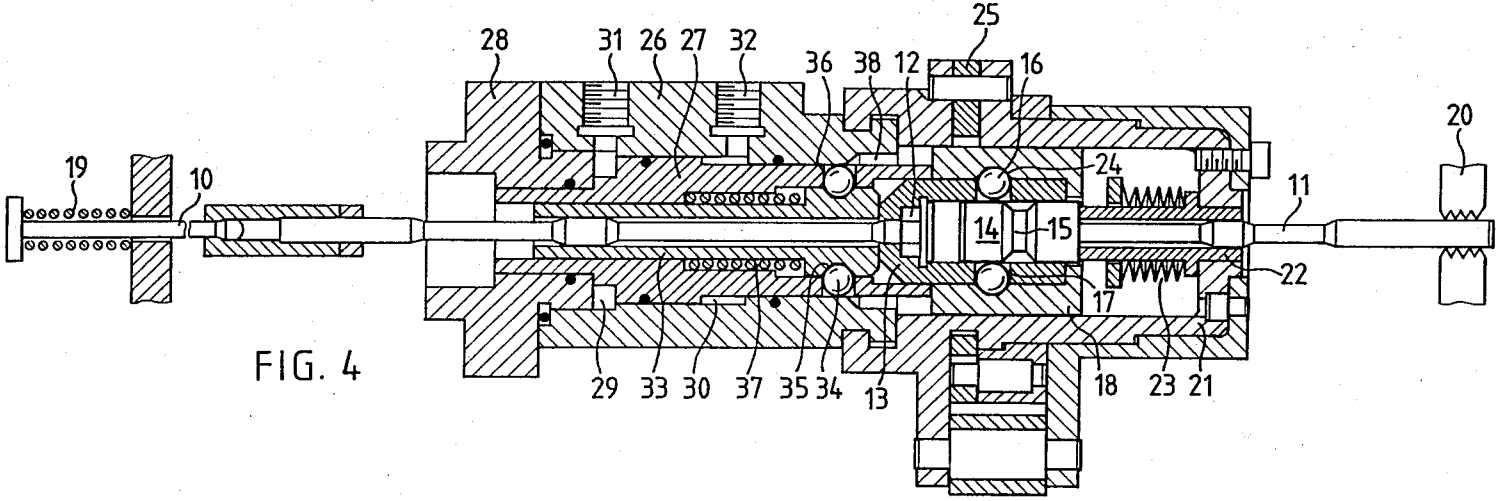

As can be seen in FIG. 3, due to the displacement of the further bushing 18 towards the left and into the releasing position, the aforementioned locking bodies 16 arrive at a groove 24 provided in the inner wall of the further bushing 18. The second cable head 14 of the second switch or control cable section 11 is thereby released because the locking bodies 16 no longer project into the groove 15 of such second cable head 14. Consequently, this second cable head 14 is freely displaceable in the bushing 13. Thus, the compression spring 19 is enabled to displace the first switch or control cable section 10 conjointly with the bushing 13, the locking bodies 16 and the further bushing 18 towards the left, as can be seen in FIG. 4. A pawl 25, see FIG. 2, serves for releasing the further bushing 18. The pawl 25 is operable in a manner here not particularly shown, i.e. by hand, by means of a cartridge or any other suitable operating means. In this case, a displacement of the first or left-hand switch or control cable section 10 is rendered possible even if the second or right-hand switch or control cable section 11 is retained by the clamping arrangement or holding device 20.

Figure 5:
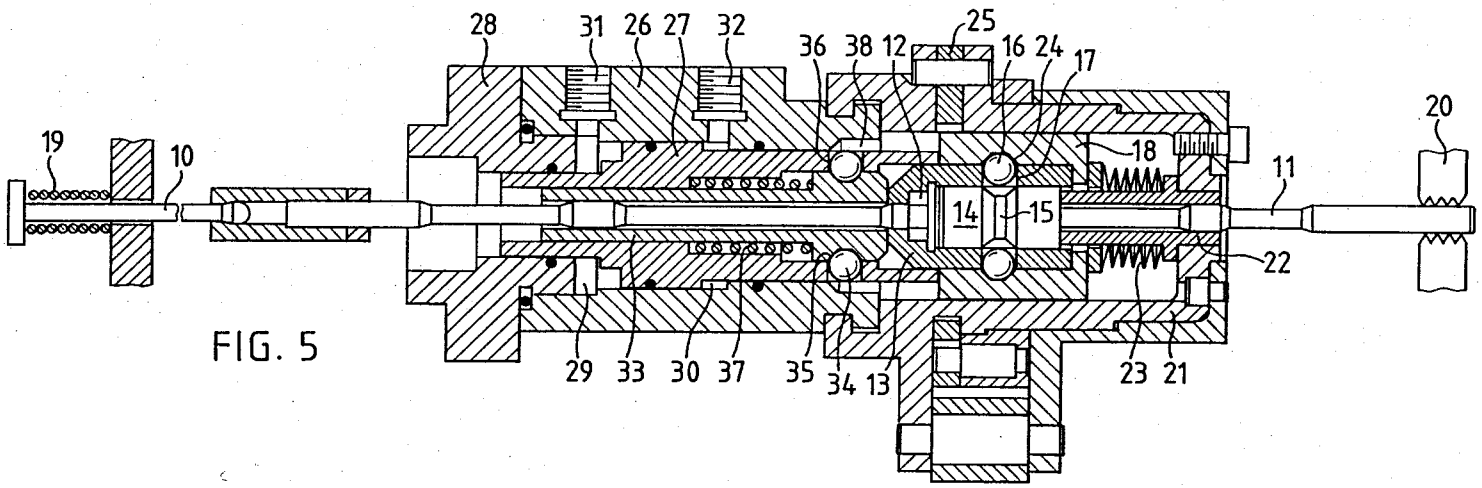

In accordance with FIG. 5, a further housing 26 is secured to the housing 21 and a sleeve-shaped piston 27 is displaceably guided in such further housing 26. The further housing 26 is closed by means of a cover 28. Two pressure chambers 29 and 30 are provided for displacing the sleeveshaped piston 27 in the further housing 26 and connected to a here not particularly shown source of hydraulic oil by means of hydraulic conduit connections 31 and 32. A plunger 33 is displaceably guided in the sleeve-shaped piston 27 and can be prevented from displacement by means of locking bodies 34. These locking bodies 34 project into a groove 35 of the plunger 33 and into radial bores or holes 36 of the sleeve-shaped piston 27. A spring 37 is supported at a shoulder of the sleeve-shaped piston 27 and at a shoulder of the plunger 33. This spring 37 has the tendency to press the plunger 33 against the bushing 13. As soon as the sleeve-shaped piston 27 is pushed somewhat towards the right in the further housing 26, see FIG. 5, the locking bodies 34 can enter a wide groove 38 in the further housing 26 and thus no longer project into the groove 35 of the plunger 33, as shown in FIG. 6.

Figure 6:
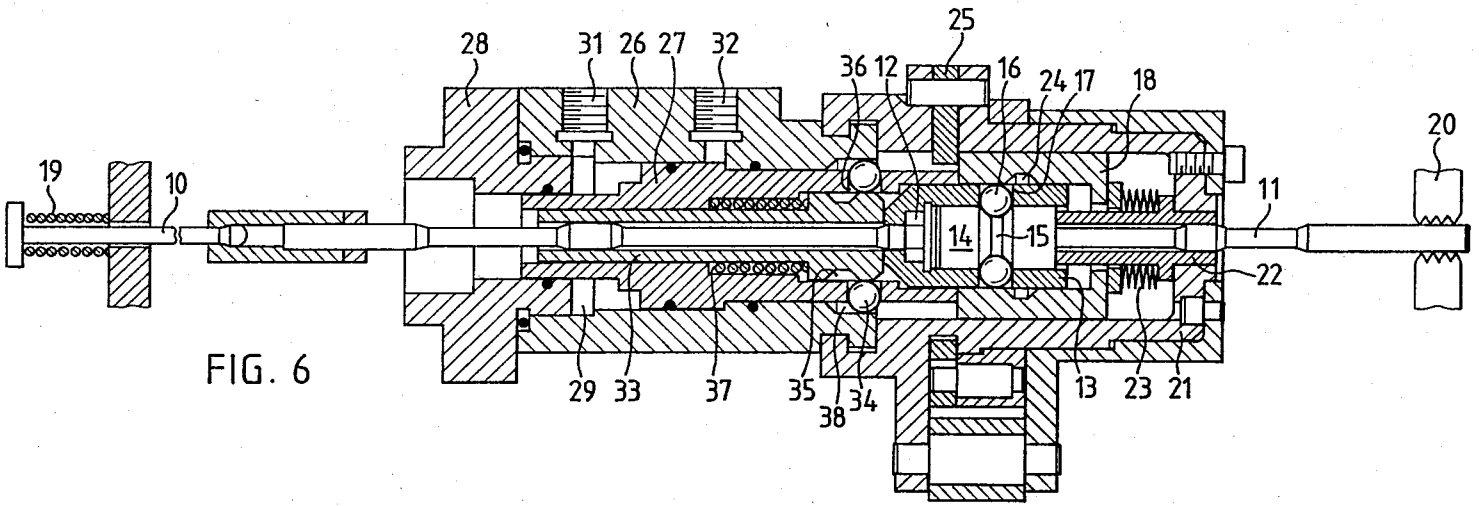

In accordance with FIG. 6, the piston 27 has been hydraulically displaced completely towards the right and has pushed the further bushing 18 towards the right to such an extent that the compression spring 23 has been compressed and the further bushing 18 has been returned into the blocking position already shown in FIG. 1. Consequently, also the plunger 33 has been displaced in the sleeve-shaped piston 27, thus compressing the spring 37. Furthermore, the further bushing 18 has been displaced relative to the bushing 13. As a consequence, the locking bodies 16 have been pushed into the groove 15 of the second cable head 14 of the second switch or control cable section 11 such that the second cable head 14 can no longer be displaced in the bushing 13.

Figure 7:
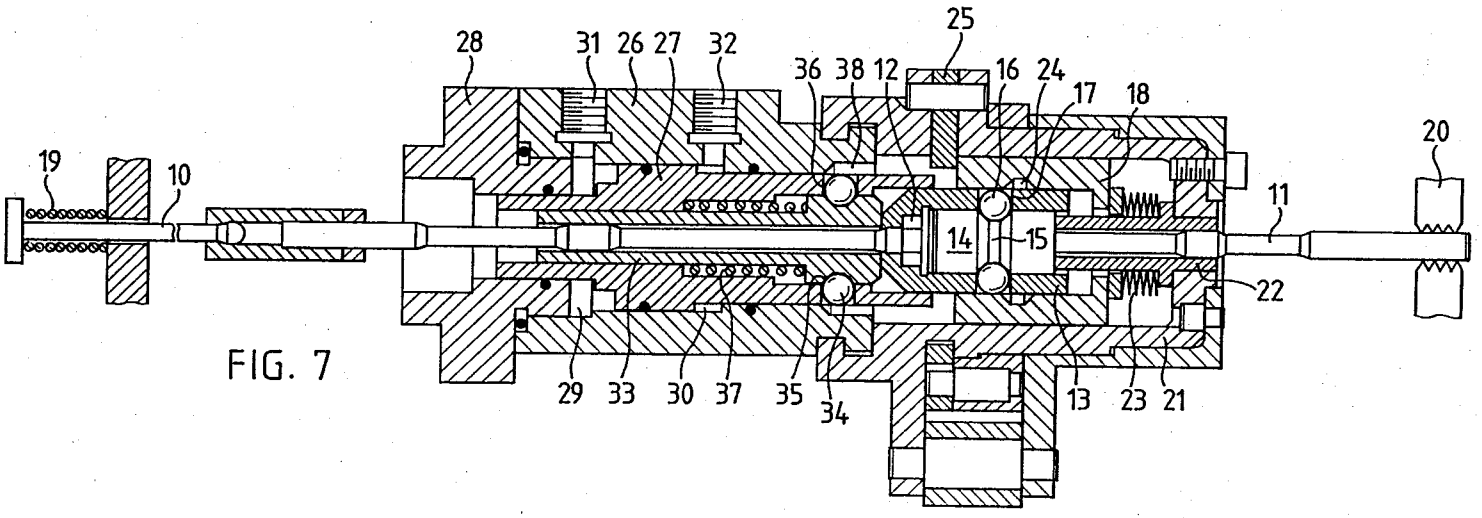

In accordance with FIG. 7, the hydraulic piston 27 was again partly displaced towards the left. However, the further bushing 18 is held by means of the pawl 25 and therefore can no longer be displaced towards the left under the force of the compression spring 23.

As soon as the starting position shown in FIG. 1 is reached again, i.e. when the hydraulic piston 27 has been pushed completely towards the left, then the locking bodies 34 are pushed through the inner wall of the housing 26 back into the groove 35 of the plunger 33. Thus, the plunger 33 can no longer be displaced in the sleeve-shaped piston 27 and likewise the locking bodies 16 are pushed through the inner wall of the further bushing 18 into the groove 15 of the second cable head 14 of the second switch or control cable section 11, so that this second cable head or body 14 can no longer be displaced in the further bushing 18.

The mode of operation of the switch or control cable 9 containing the coupling constituted by the bushing 13, the locking bodies 16 and the further bushing 18, as described hereinbefore, is as follows:

In accordance with FIG. 1 the switch or control cable 9 containing the two switch or control cable sections 10 and 11 is displaceable by an amount a in the housings 21 and 26 as soon as the clamping arrangement or holding device 20 is opened and the compression spring 19 can be released. The two switch or control cable sections 10 and 11 of the switch or control cable 9 are coupled to each other because, as previously mentioned, the locking bodies 16 are pressed through the inner wall of the further bushing 18 into the groove 15 of the second cable head 14 of the aforementioned second switch or control cable section 11. A displacement of the second cable head 14 in the bushing 13, therefore, is impossible and the first cable head 12 of the aforementioned first switch or control cable section 10 in any case is fixedly anchored in the bushing 13. The second switch or control cable section 11 is displaceably guided in the sleeve 22 and the first switch or control cable section 10 is displaceably guided in the plunger 33.

In accordance with FIGS. 1, 3 and 4, only the first switch or control cable section 10 is displaceable in the housings 21 and 26 by the amount a as soon as the pawl 25, see FIG. 2, is operated. When the pawl 25 is operated, the compression spring 23 can displace the further bushing 18 towards the left into the releasing position in which the groove 24 of this further bushing 18 is located in the area or region of the locking bodies 16, see FIG. 3. Consequently, these locking bodies 16 can enter this groove 24 of the further bushing 18 and, as can be seen in FIG. 3, can be pushed out from the groove 15 of the second cable head 14 of the second switch or control cable section 11. Therefore, the second cable head 14 is freely displaceable relative to the bushing 13. However, a displacement of the second switch or control cable section 11 and the second cable head 14 is prevented by the clamping arrangement or holding device 20. Conversely, the compression spring 19 can displace the first switch or control cable section 10 conjointly with the first cable head 12 and the bushing 13 fastened thereto by the amount a, see FIG. 1, towards the left as will be evident from FIG. 4. During this operation, the second cable head 14 is displaced relative to the bushing 13 and secures the locking bodies 16 in their outermost position in which they project into the groove 24.

It will be evident from the mode of operation described hereinbefore that the displacement of the first switch or control cable section 10 by the amount a, see Figure 1, can be achieved either by operating the clamping arrangement or holding device 20 or by operating the pawl 25, see FIG. 3.

The herein described switch or control cable coupling 13, 16, 18 is suited, for instance, for use in a Gatling gun which has to be switched-off when encountering a delayed firing of a cartridge as well as after a single shot. In the presence of a delayed firing cartridge, the clamping arrangement or holding device 20 is opened. If a single-shot operation is desired, then the pawl 25 is operated by means of the first cartridge to be fired for releasing the further bushing 18. In both cases the displacement of the first switch or control cable section 10 has the effect that a series or continuous firing operation of the gun is immediately interrupted.

While there are shown and described present preferred embodiments of the invention, it is to be distinctly understood that the invention is not limited thereto, but may be otherwise variously embodied and practiced within the scope of the following claims.

Accordingly, what we claim is:

1. A switch cable arrangement, comprising:

a switch cable;

a holding device releasably holding said switch cable;

a spring tensioning said switch cable;

said switch cable containing a first switch cable section and a second switch cable section;

a coupling disengageably interconnecting said first switch cable section and said second switch cable section;

said first switch cable section being displaceable under the action of said spring when said coupling is disengaged; and said first switch cable section and said second switch cable section being conjointly displaceable under the action of said spring when said coupling is engaged and said switch cable is released from said holding device.

2. The switch cable arrangement as defined in claim 1, further including:

a first cable head fixed to said first switch cable section;

a second cable head fixed to said second switch cable section and possessing a groove;

a bushing possessing at least one radial hole;

said first cable head being fixedly anchored at said bushing;

said second cable head being displaceably guided in said bushing;

at least one locking body located in said at least one radial hole in said bushing;

said at least one locking body engaging said groove of said second cable head and thereby interconnecting said first switch cable section and said second switch cable section;

a further bushing; and said further bushing securing said at least one , locking body and thereby preventing displacement of said second cable head in said bushing.

3. The switch cable arrangement as defined in claim 2, further including:

a housing;

said further bushing being arranged in said housing for displacement between a blocking position and a releasing position;

a compression spring loading said further bushing and urging said further bushing into said releasing position;

a pawl displaceably mounted in said housing and retaining said further bushing in said blocking position;

said bushing being displaceably guided in said further bushing;

said further bushing possessing a groove on its inside;

said at least one locking body engaging said groove on the inside of said further bushing and thereby releasing said second cable head when said pawl is displaced and said further bushing is displaced into its releasing position under the action of said compression spring; and said bushing, said at least one blocking body, and said further bushing constituting said coupling disengageably interconnecting said first switch cable section and said second switch cable section.

4. The switch cable arrangement as defined in claim 1, further including:

a further housing provided at said coupling;

a hydraulic piston displaceably guided in said further housing; and said hydraulic piston being displaceable in said further housing for displacing said further bushing from its releasing position into its blocking position and substantially simultaneously said bushing in order to engage said coupling for interconnecting said first switch cable section and said second switch cable section.

* * * * *